US008147285B2

(12) United States Patent
Okabe et al.

(10) Patent No.: US 8,147,285 B2
(45) Date of Patent: Apr. 3, 2012

(54) MARINE VESSEL PROPULSION UNIT

(75) Inventors: Yoshihiko Okabe, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 243 days.

(21) Appl. No.: 12/618,879

(22) Filed: Nov. 16, 2009

(65) Prior Publication Data

US 2010/0124858 A1 May 20, 2010

(30) Foreign Application Priority Data

Nov. 17, 2008 (JP) ..... 2008-292970
Jan. 22, 2009 (JP) ..... 2009-012335

(51) Int. Cl.
*B63H 20/14* (2006.01)

(52) U.S. Cl. ..... 440/75

(58) Field of Classification Search ..... 440/75, 440/76, 84, 86
See application file for complete search history.

(56) References Cited

U.S. PATENT DOCUMENTS 2,741,351 A * 4/1956 Holmes et al. ..... 192/218
4,009,677 A * 3/1977 Croisant ..... 440/6
4,832,630 A * 5/1989 Alexander et al. ..... 440/6
5,238,433 A 8/1993 Hayasaka
6,884,131 B2 * 4/2005 Katayama et al. ..... 440/75
7,625,255 B2 * 12/2009 Ide et al. ..... 440/88 M
7,892,056 B2 * 2/2011 Okabe et al. ..... 440/88 D
8,075,357 B2 * 12/2011 Fukuoka et al. ..... 440/88 L

FOREIGN PATENT DOCUMENTS

JP 1-262287 A 10/1989
JP 5-85476 A 4/1993
JP 6-207647 A 7/1994
JP 8-268390 A 10/1996

* cited by examiner

*Primary Examiner* — Lars A Olson
*Assistant Examiner* — Andrew Polay
(74) *Attorney, Agent, or Firm* — Keating & Bennett, LLP

(57) ABSTRACT

A marine vessel propulsion unit includes an engine, a drive shaft, a propeller shaft, a propeller, an intermediate shaft, and a first reduction gear mechanism. The drive shaft is arranged to be rotated by the engine. The rotation of the drive shaft is transmitted to the propeller shaft. The propeller is arranged to be rotated together with the propeller shaft. The intermediate shaft is arranged on a central rotation axis of the propeller shaft or an extension of the central rotation axis. The intermediate shaft is arranged to transmit rotation between the drive shaft and the propeller shaft. The first reduction gear mechanism is arranged on a central rotation axis of the propeller shaft or the extension of the central rotation axis. The first reduction gear mechanism is arranged to decelerate the rotation of the intermediate shaft so as to transmit the decelerated rotation to the propeller shaft during both forward propulsion and backward propulsion.

13 Claims, 9 Drawing Sheets

MARINE VESSEL PROPULSION UNIT

BACKGROUND OF THE INVENTION

1. Field of the Invention

The present invention relates to a marine vessel propulsion unit.

2. Description of the Related Art

A prior art marine vessel propulsion unit is described in Japanese Published Unexamined Patent Application No. 06-207647. The marine vessel propulsion unit includes an engine, a drive shaft extending up and down, a propeller shaft extending in the front-back direction, a propeller which is rotated together with the propeller shaft, and a planetary gear mechanism arranged on an outer peripheral portion of the propeller shaft.

The planetary gear mechanism is arranged on the upstream side of a dog clutch in a driving force transmission path from the engine to the propeller. The marine vessel propulsion unit is arranged to decelerate the rotation of the drive shaft by the planetary gear mechanism and transmit the decelerated rotation to the propeller shaft when propelling the hull backward. The marine vessel propulsion unit is arranged to directly transmit a driving force from the drive shaft to the propeller shaft without the planetary gear mechanism when propelling the hull forward. In other words, the marine vessel propulsion unit is arranged to transmit a high-torque driving force to the propeller when propelling the hull backward.

SUMMARY OF THE INVENTION

The inventors of the preferred embodiments of the present invention described and claimed in the present application conducted an extensive study and research regarding the design and development of a marine vessel propulsion unit, and in doing so, discovered and first recognized new unique challenges and problems as described in greater detail below.

That is, in the marine vessel propulsion unit relating to the above-described prior art, when propelling the hull backward, a high-torque driving force is transmitted to the propeller by the planetary gear mechanism. On the other hand, when propelling the hull forward, a high-torque driving force is hardly transmitted to the propeller. Therefore, the marine vessel propulsion unit hardly transmits a high-torque driving force to the propeller when propelling the hull forward and when propelling the hull backward.

In order to overcome the previously unrecognized and unsolved problems described above, a preferred embodiment of the present invention provides a marine vessel propulsion unit including an engine, a drive shaft , a propeller shaft, a propeller, an intermediate shaft, and a first reduction gear mechanism. The drive shaft is arranged to be rotated by the engine. The rotation of the drive shaft is transmitted to the propeller shaft. The propeller is arranged to be rotated together with the propeller shaft. The intermediate shaft is arranged on a central rotation axis of the propeller shaft or an extension of the central rotation axis. The intermediate shaft is arranged to transmit rotation between the drive shaft and the propeller shaft. The first reduction gear mechanism is arranged on the central rotation axis of the propeller shaft or the extension of the central rotation axis. The first reduction gear mechanism is arranged to decelerate the rotation of the intermediate shaft so as to transmit the decelerated rotation to the propeller shaft both in forward propulsion and backward propulsion.

With this arrangement, the drive shaft is rotated by the engine, and the rotation of the drive shaft is transmitted to the intermediate shaft. Then, the rotation of the intermediate shaft is decelerated by the first reduction gear mechanism and transmitted to the propeller shaft when propelling the hull forward and backward. Accordingly, when propelling the hull forward and when propelling the hull backward, a high-torque driving force is transmitted to the propeller. Also, the first reduction gear mechanism is arranged on the central rotation axis of the propeller shaft or the extension of the central rotation axis, so that the area to which a great driving force is applied is limited to the range on the downstream side of the drive shaft in the driving force transmission path from the engine to the propeller. Accordingly, a high-torque driving force can be prevented from being applied to the drive shaft and the drive system, etc., arranged on the upstream side of the drive shaft.

The marine vessel propulsion unit may further include a forward-reverse switching mechanism which is arranged to switch the rotation direction of the propeller shaft to the forward or reverse drive direction. In this case, the first reduction gear mechanism may be arranged on the downstream side of the forward-reverse switching mechanism in the driving force transmission path from the engine to the propeller.

The marine vessel propulsion unit may further include a second reduction gear mechanism which is arranged to be capable of decelerating the rotation of the drive shaft and transmitting the decelerated rotation to the intermediate shaft.

The marine vessel propulsion unit may further include a forward-reverse switching mechanism which is arranged to switch the rotation direction of the propeller shaft to the forward or reverse drive direction. In this case, the second reduction gear mechanism may include an output gear, a first bevel gear, and a second bevel gear. The output gear may be integrally joined to the drive shaft. The first bevel gear may be arranged to be engaged with the output gear and rotated in a first direction about the central rotation axis of the propeller shaft. The second bevel gear may be arranged to be engaged with the output gear and rotated in a second direction opposite to the first direction about the central axis of the propeller shaft. Also, the forward-reverse switching mechanism may include a clutch portion which is integrally joined to the intermediate shaft and joined to either the first bevel gear or the second bevel gear.

Also, the marine vessel propulsion unit may further include a first bearing in which the first bevel gear is fitted. In this case, the first bevel gear may be arranged to press the first bearing by being pressed by the intermediate shaft to reduce an internal space of the first bearing when the hull is moved forward.

Also, the first reduction gear mechanism may include a planetary gear mechanism arranged on an outer peripheral portion of the propeller shaft.

Also, the marine vessel propulsion unit may further include a housing which is arranged to house the planetary gear mechanism. In this case, the planetary gear mechanism may include a ring gear, a sun gear, planetary gears, and a carrier. The ring gear may be arranged to be integrally joined to the intermediate shaft and rotated about the central rotation axis of the propeller shaft. The sun gear may be positioned on the inner side of the ring gear and fixed to the housing. The planetary gears may be arranged to be engaged with the ring gear and the sun gear by being sandwiched therebetween, and arranged to move around the sun gear according to rotation of the ring gear. The carrier may be arranged to support the planetary gears. The carrier may be arranged to be rotated about the central rotation axis of the propeller shaft in a state in which the rotation is decelerated to be slower than the intermediate shaft according to the movements of the planetary gears around the sun gear. Also, the propeller shaft may be arranged to rotate together with the carrier.

The intermediate shaft may include a flange portion which is arranged to extend in a direction that is perpendicular or substantially perpendicular to the extending direction of the intermediate shaft, and an engagement portion which is provided on an outer peripheral portion of the flange portion. In this case, the engagement portion of the intermediate shaft may be arranged to be engaged with the ring gear.

The sun gear may have a tubular shape surrounding the outer peripheral surface of the propeller shaft. In this case, the marine vessel propulsion unit may further include a second bearing arranged between the inner peripheral surface of the sun gear and the outer peripheral surface of the propeller shaft.

The intermediate shaft and the carrier may be opposed to each other. In this case, the marine vessel propulsion unit may further include a third bearing arranged between portions opposed to each other of the intermediate shaft and the carrier.

Also, the propeller shaft and the intermediate shaft may include oil passages arranged to supply oil to the first reduction gear mechanism.

Other elements, features, steps, characteristics, and advantages of the present invention will become more apparent from the following detailed description of the preferred embodiments with reference to the attached drawings.

DETAILED DESCRIPTION OF THE PREFERRED EMBODIMENTS

First, with reference to FIG. 1 to FIG. 9, arrangements of outboard motors 3 and 4 installed in a marine vessel 1 according to preferred embodiments of the present invention will be described. FWD in the figures indicates the forward drive direction of the marine vessel, and BWD in the figures indicates the reverse drive direction of the marine vessel.

Figure 1:
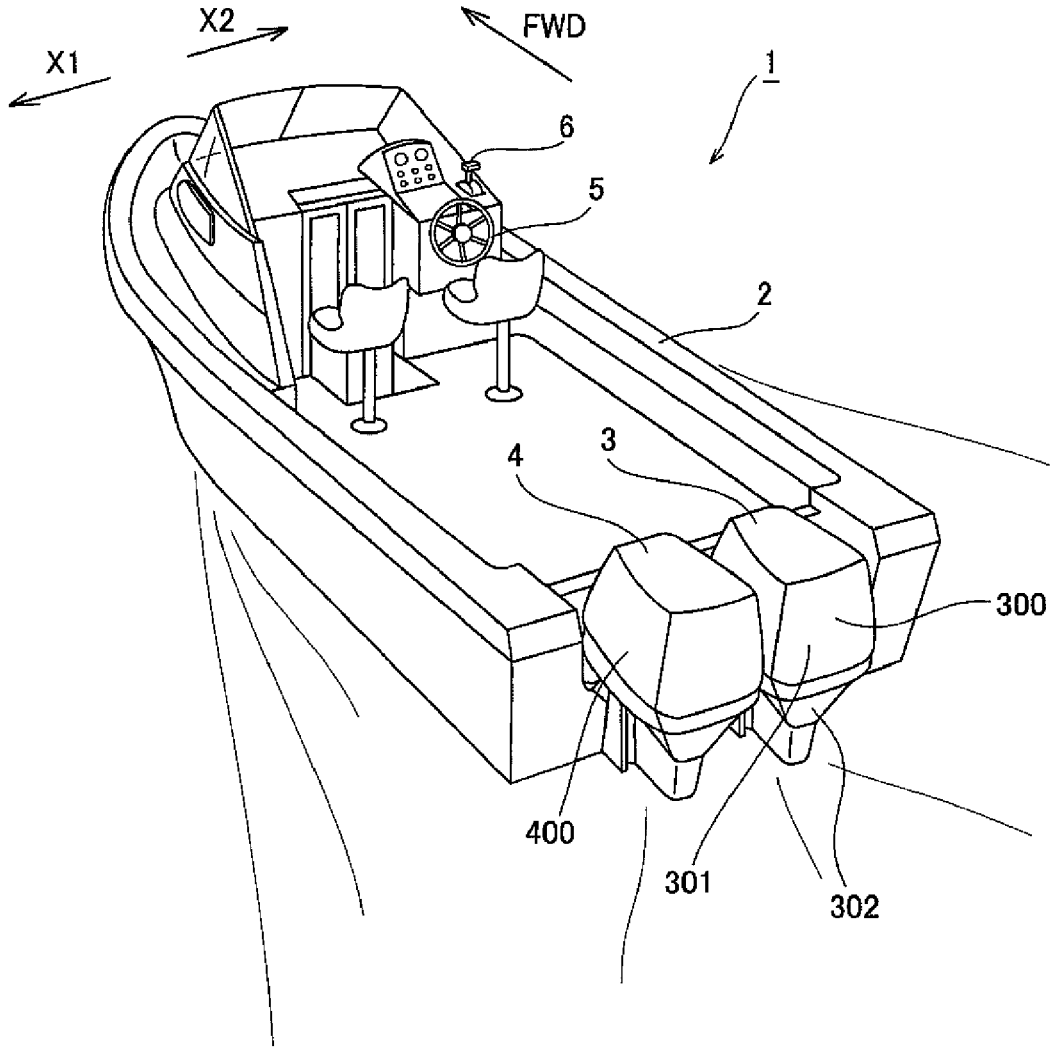
FIG. 1 is a perspective view showing a marine vessel equipped with outboard motors according to a preferred embodiment of the present invention.

FIG. 1 is a perspective view showing a marine vessel equipped with outboard motors according to a preferred embodiment of the present invention.

The marine vessel 1 includes a hull 2 floating on the water surface, two outboard motors 3 and 4 attached to a rear portion of a hull 2, a steering portion 5 for steering the hull 2, and a control lever portion 6 arranged near the steering portion 5. Hull 2 is propelled by the two outboard motors 3 and 4. Also, forward driving and reverse driving of the hull 2 are switched by operating the control lever portion 6. The outboard motors 3 and 4 are an example of a "marine vessel propulsion unit" according to a preferred embodiment of the present invention.

The two outboard motors 3 and 4 are arranged symmetrically about the center in the lateral direction (the arrow X1 direction and the arrow X2 direction) of the hull 2. The outboard motor 3 preferably is an outboard motor with forward rotation specifications including one propeller 33 (see FIG. 3). Also, the outboard motor 4 is an outboard motor with reverse rotation specifications including one propeller 43 (see FIG. 7). The outboard motors 3 and 4 are arranged to rotate the propellers 33 and 43 in mutually different directions when propelling the hull 2 forward or backward.

Also, the outboard motors 3 and 4 are covered by cases 300 and 400, respectively. The cases 300 and 400 are made of, for example, a resin or a metal. The cases 300 and 400 protect the interiors of the outboard motors 3 and 4 from water, etc.

Next, an arrangement of the outboard motor 3 with forward rotation specifications will be described in detail with reference to FIG. 2 and FIG. 3.

Figure 2:
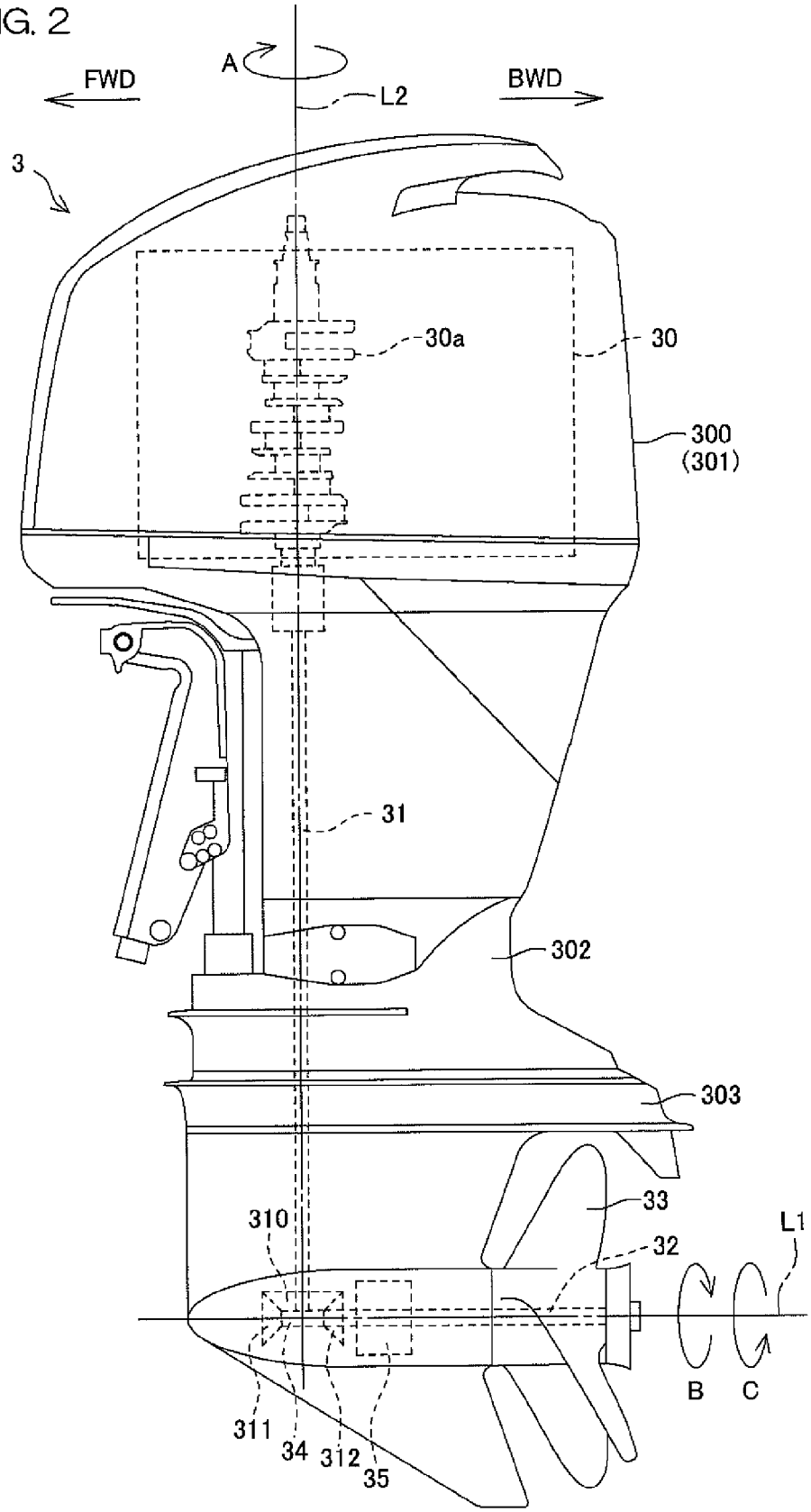
FIG. 2 is an external view for describing an arrangement of an outboard motor with forward rotation specifications according to a preferred embodiment of the present invention.
Figure 3:
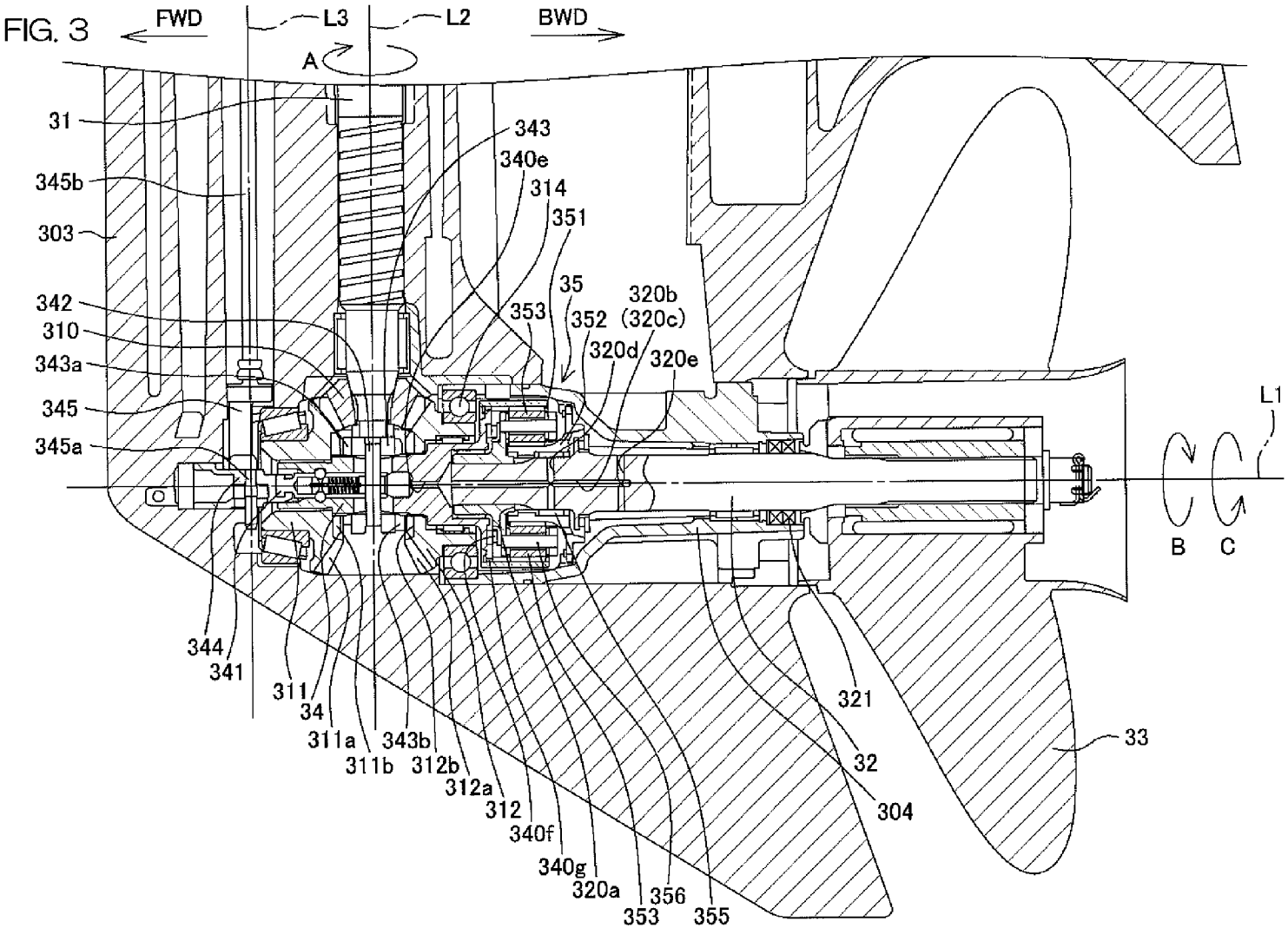
FIG. 3 is a sectional view for describing an arrangement inside a lower case of the outboard motor with forward rotation specifications according to a preferred embodiment of the present invention.

FIG. 2 is an external view for describing an arrangement of an outboard motor with forward rotation specifications of a preferred embodiment of the present invention. FIG. 3 is a sectional view for describing an arrangement inside a lower case of the outboard motor with forward rotation specifications according to the present preferred embodiment of the present invention.

As shown in FIG. 2, the outboard motor 3 includes an engine 30, a drive shaft 31, a propeller shaft 32, and a propeller 33. The drive shaft 31 extends up and down below the engine 30. The drive shaft 31 is rotated by the engine 30. Also, the propeller shaft 32 extends in a direction that is perpendicular or substantially perpendicular to (crossing) the drive shaft 31. The propeller 33 is integrally joined to the rear end portion of the propeller shaft 32. The propeller 33 is arranged to generate a propulsive force in the forward drive direction when it is rotated in the direction B. Further, the propeller 33 is arranged to generate a propulsive force in the reverse drive direction when it is rotated in the direction C. Therefore, in the outboard motor 3 with forward rotation specifications, the direction B is the forward drive direction, and the direction C is the reverse drive direction.

The outboard motor 3 includes an intermediate shaft 34 and a planetary gear mechanism 35. The intermediate shaft 34 extends in the direction perpendicular or substantially perpendicular (crossing) the drive shaft 31 in front of the propeller shaft 32. The rotation of the drive shaft 31 is transmitted to the intermediate shaft 34. The rotation of the intermediate shaft 34 is decelerated by the planetary gear mechanism 35 and transmitted to the propeller shaft 32. The planetary gear mechanism 35 is arranged on a central rotation axis L1 of the propeller shaft 32. The intermediate shaft 34 is an example of "an intermediate shaft" according to a preferred embodiment of the present invention, and the planetary gear mechanism 35 is an example of "a first reduction gear mechanism" according to a preferred embodiment of the present invention.

Next, with reference to FIG. 2 and FIG. 3, the structure of a drive system including the engine 30 and the planetary gear mechanism 35, etc., will be described.

As shown in FIG. 2, the case 300 includes an engine cover 301, an upper case 302, and a lower case 303. The engine 30 is housed in the engine cover 301. The engine 30 includes a crankshaft 30*a* arranged to rotate in the direction A about an axis L2. The direction A is, for example, the clockwise direction as viewed from above. The crankshaft 30*a* is arranged along the axis L2. The drive shaft 31 is arranged along the axis L2 below the crankshaft 30*a*. A lower end portion of the crankshaft 30*a* is joined to an upper end portion of the drive shaft 31. The drive shaft 31 is arranged to rotate in the direction A together with the crankshaft 30*a*. The drive shaft 31 is housed in the upper case 302 and the lower case 303.

A bevel gear 310 is attached to a lower end portion of the drive shaft 31 so as to rotate in the direction A together with the drive shaft 31. As shown in FIG. 3, the bevel gear 310 is engaged with a gear portion 311*a* of a front bevel gear 311. Further, the bevel gear 310 is engaged with a gear portion 312*a* of a rear bevel gear 312 arranged at the rear of the front bevel gear 311. The bevel gear 310 is an example of "a second reduction gear mechanism" and "an output gear" according to a preferred embodiment of the present invention. Also, the front bevel gear 311 is an example of "a second reduction gear mechanism" and "a first bevel gear" according to a preferred embodiment of the present invention. Also, the rear bevel gear 312 is an example of "a second reduction gear mechanism" and "a second bevel gear" according to a preferred embodiment of the present invention.

The front bevel gear 311 is arranged to rotate in the direction B about the central rotation axis L1 of the propeller shaft 32 according to rotation in the direction A of the bevel gear 310. The gear ratio of the bevel gear 310 to the front bevel gear 311 is, for example, approximately 1.75. Therefore, the rotation of the bevel gear 310 is decelerated and transmitted to the front bevel gear 311.

Also, the rear bevel gear 312 is arranged to rotate in the direction C opposite to the direction B about the central rotation axis L1 of the propeller shaft 32 according to rotation in the direction A of the bevel gear 310. The gear ratio of the bevel gear 310 to the rear bevel gear 312 is equal to, for example, approximately 1.75 of the gear ratio of the bevel gear 310 to the front bevel gear 311. Therefore, the rotation of the bevel gear 310 is decelerated and transmitted to the rear bevel gear 312.

The direction B is an example of "a first direction" according to a preferred embodiment of the present invention, and the direction C is an example of "a second direction" according to a preferred embodiment of the present invention. The direction B is, for example, the clockwise direction when the propeller shaft 32 is viewed from the rear side (the arrow BWD side) of the outboard motor 3 (outboard motor 4). The direction C is, for example, the counterclockwise direction when the propeller shaft 32 is viewed from the rear side of the outboard motor 3 (outboard motor 4).

Figure 4:
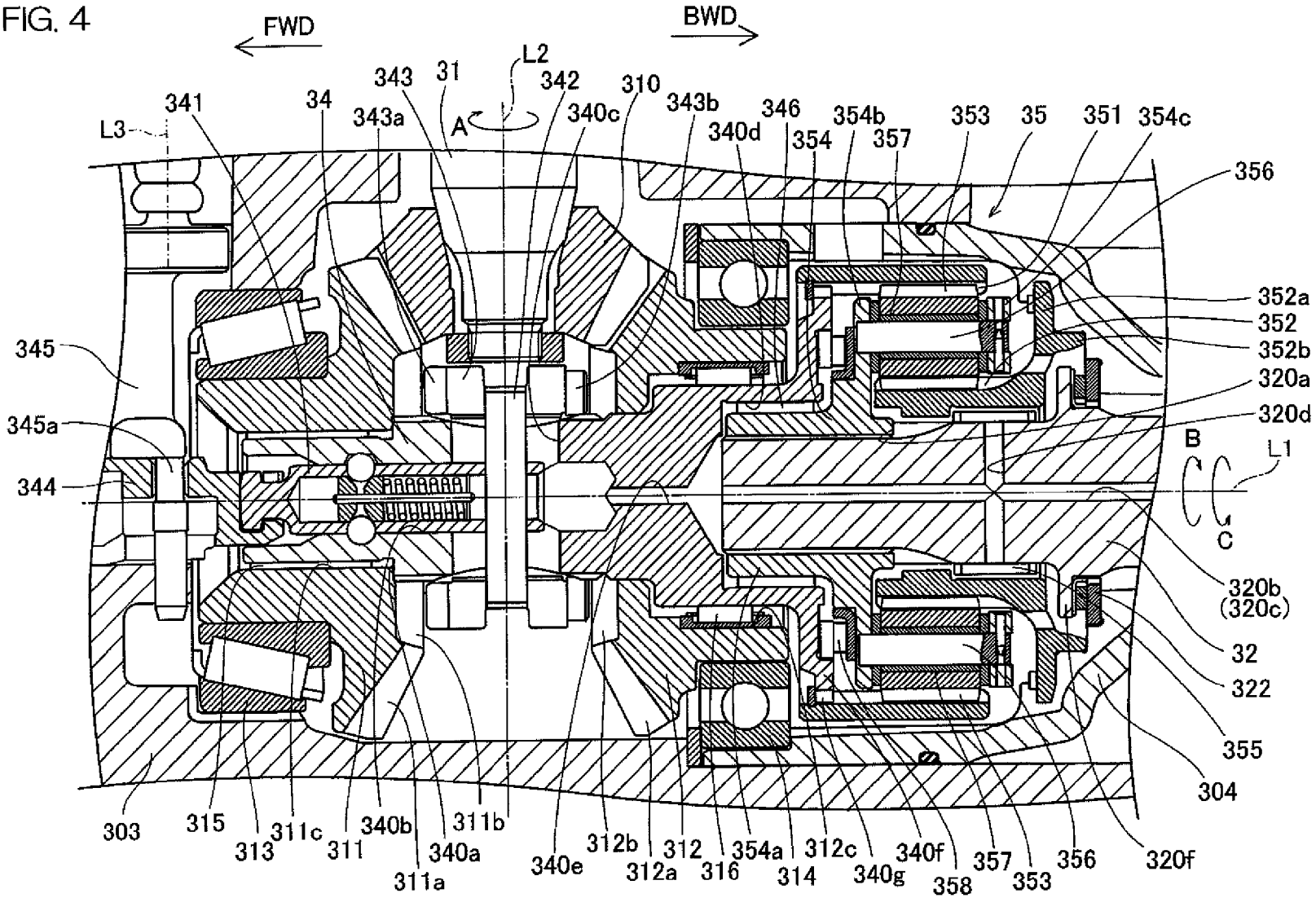
FIG. 4 is a sectional view for describing arrangements of an intermediate shaft and a planetary gear mechanism of the outboard motor with forward rotation specifications according to a preferred embodiment of the present invention.

FIG. 4 is a sectional view for describing arrangements of the intermediate shaft and the planetary gear mechanism of the outboard motor with forward rotation specifications according to the present preferred embodiment of the present invention.

The front bevel gear 311 is fitted in a bearing 313. The bearing 313 is an example of "a first bearing" according to a preferred embodiment of the present invention. The bearing 313 is, for example, a tapered bearing (conical roller bearing). The bearing 313 is fixed to the lower case 303. The front bevel gear 311 is arranged to press the bearing 313 forward by being pressed forward by the intermediate shaft 34 when the hull 2 (see FIG. 1) is moved forward. The bearing 313 is capable of stably bearing the front bevel gear 311 even when the front bevel gear 311 is urged in a direction of pressing the bearing 313.

Also, the rear bevel gear 312 is fitted in a bearing 314. The bearing 314 is fixed to the lower case 303 via a housing 304. The bearing 314 is arranged to stably support the rear bevel gear 312 even when the rear bevel gear 312 is rotated about the central rotation axis L1.

Also, the intermediate shaft 34 is arranged below the bevel gear 310. The intermediate shaft 34 extends in the front-back direction (the arrow FWD direction and the arrow BWD direction). The intermediate shaft 34 is arranged on the central rotation axis L1 of the propeller shaft 32. A front end portion of the intermediate shaft 34 is inserted in an open hole 311*c* provided in the front bevel gear 311. The open hole 311*c* extends along the central rotation axis L1. Also, a rear portion of the intermediate shaft 34 is inserted in an open hole 312*c* provided in the rear bevel gear 312. The open hole 312*c* extends along the central rotation axis L1.

A bushing 315 is fitted into the inner peripheral surface of the open hole 311*c* provided in the front bevel gear 311. The intermediate shaft 34 is arranged to idle with respect to the front bevel gear 311. On the other hand, a bearing 316 is fitted into the inner peripheral surface of the open hole 312*c* provided in the rear bevel gear 312. The intermediate shaft 34 is arranged to idle with respect to the rear bevel gear 312.

Also, in a front portion of the intermediate shaft 34, an insertion hole 340*b* extending along the central rotation axis L1 is provided. Further, in the intermediate shaft 34, a through hole 340*c* perpendicular or substantially perpendicular to the insertion hole 340*b* is provided. The through hole 340*c* is arranged to have a slotted hole shape extending in the front-back direction.

In the insertion hole 340*b*, a slide member 341 arranged to slide in the front-back direction inside the insertion hole 340*b* is inserted. A rear end portion of the slide member 341 is positioned inside the through hole 340*c*. A bar-shaped joint member 342 is attached to the rear end portion of the slide member 341. The joint member 342 is attached to the slide member 341 so as to become perpendicular or substantially perpendicular to the slide member 341. The joint member 342 is arranged to be slid inside the through hole 340*c* together with the slide member 341 when the slide member 341 is slid along the insertion hole 340*b*.

The joint member 342 penetrates through the through hole 340*c* vertically. An upper end portion and a lower end portion of the joint member 342 project to the outside from the outer peripheral surface of the intermediate shaft 34, respectively. A dog clutch 343 is fixed to both end portions of the joint member 342. The dog clutch 343 is an example of "a forward-reverse switching mechanism" and "a clutch portion" according to a preferred embodiment of the present invention. The dog clutch 343 surrounds the outer peripheral surface of the intermediate shaft 34. The dog clutch 343 is spline-engaged with the outer peripheral surface of the intermediate shaft 34. The dog clutch 343 is arranged to rotate about the central rotation axis L1 together with the joint member 342. Further, the dog clutch 343 is arranged to slide in the front-back direction with respect to the intermediate shaft 34.

Also, at an end portion on the arrow FWD direction side of the dog clutch 343, a front dog 343*a* is provided. Further, at an end portion on the arrow BWD direction side of the dog clutch 343, a rear dog 343*b* is provided. By sliding the dog clutch 343 in the arrow FWD direction with respect to the intermediate shaft 34, the front dog 343*a* is engaged with a dog portion 311*b* of the front bevel gear 311. By sliding the dog clutch 343 in the arrow BWD direction with respect to the intermediate shaft 34, the rear dog 343*b* is engaged with a dog portion 312*b* of the rear bevel gear 312. When the dog clutch 343 is arranged at an intermediate position between the front bevel gear 311 and the rear bevel gear 312, the front dog 343*a* and the rear dog 343*b* separate from the dog portion 311*b* and the dog portion 312*b*, respectively.

The rotation in the direction B (forward drive direction) about the central rotation axis L1 of the front bevel gear 311 is transmitted to the intermediate shaft 34 by the engagement of the front dog 343*a* with the dog portion 311*b* of the front bevel gear 311. Also, the rotation in the direction C (reverse drive direction) about the central rotation axis L1 of the rear bevel gear 312 is transmitted to the intermediate shaft 34 by the engagement of the rear dog 313*b* with the dog portion 312*b* of the rear bevel gear 312. Also, when the dog clutch 343 is arranged at the intermediate position between the front bevel gear 311 and the rear bevel gear 312, the rotations of the front bevel gear 311 and the rear bevel gear 312 are not transmitted to the intermediate shaft 34.

Also, a joint member 344 is engaged with a front end portion of the slide member 341. The joint member 344 is engaged with a protrusion 345*a* of a forward-reverse switching lever 345. The forward-reverse switching lever 345 is connected to an actuator not shown arranged inside the engine cover 301 via an interlocking mechanism 345*b* (see FIG. 3). The forward-reverse switching lever 345 is turned around the axis L3 by the actuator not shown. Also, the protrusion 345*a* is moved in the front-back direction according to turning of the forward-reverse switching lever 345. The joint member 344 is moved in the front-back direction according to the movement in the front-back direction of the protrusion 345*a*. The slide member 341 is moved in the front-back direction according to the movement in the front-back direction of the joint member 344. The "forward-reverse switching mechanism" according to a preferred embodiment of the present invention includes the slide member 341, the joint member 342, the dog clutch 343, the joint member 344, and the forward-reverse switching lever 345.

Also, on the central rotation axis L1 side of the rear end portion of the intermediate shaft 34, a recess 340*d* is provided. The recess 340*d* is arranged to allow a front end portion of the propeller shaft 32 and a front end portion of the carrier 354 of the planetary gear mechanism 35 to be inserted therein. Also, the recess 340*d* has a tubular inner peripheral surface. On the inner peripheral surface of the recess 340*d*, a bushing 346 is arranged. The bushing 346 is an example of "a third bearing" according to a preferred embodiment of the present invention. The bushing 346 functions as an oscillation stopper of the carrier 354 of the planetary gear mechanism 35.

Also, in the bottom portion of the recess 340*d*, an oil passage 340*e* to be connected to the insertion hole 340*b* is provided. The oil passage 340*e* extends in the front-back direction along the central rotation axis L1. The oil passage 340*e* is supplied with oil from the front side. The oil supplied to the oil passage 340*e* is supplied to a bearing 355 which supports the planetary gear mechanism 35 and the propeller shaft 32 and members behind these via an oil passage 320*b* provided in the propeller shaft 32.

Also, on an outer peripheral portion of the rear end portion of the intermediate shaft 34, a flange portion 340*f* extending in a direction perpendicular or substantially perpendicular to the extending direction (the arrow FWD direction and the arrow BWD direction) of the intermediate shaft 34 is provided. Also, at an outer peripheral portion of the flange portion 340*f*, a tubular engagement portion 340*g* is provided. The engagement portion 340*g* is engaged with the ring gear 351 of the planetary gear mechanism 35. The engagement portion 340*g* is arranged to transmit the rotation of the intermediate shaft 34 to the planetary gear mechanism 35.

Also, the planetary gear mechanism 35 is housed in the housing 304 attached to the lower case 303. The planetary gear mechanism 35 is arranged at the outer peripheral portion of the front end portion of the propeller shaft 32. The planetary gear mechanism 35 is provided on the downstream side of the intermediate shaft 34. In other words, the planetary gear mechanism 35 is provided on the downstream side of the slide member 341, the joint member 342, the dog clutch 343, the joint member 344, and the forward-reverse switching lever 345. "The downstream side" means the downstream side in the driving force transmission path from the engine 30 to the propeller 33. The engine 30 side in the transmission path is the upstream side, and the propeller 33 side in the transmission path is the downstream side. For example, "the downstream side of the intermediate shaft 34" is the propeller 33 side of the intermediate shaft 34 in the transmission path.

The planetary gear mechanism 35 can decelerate the rotation of the intermediate shaft 34 and transmit the decelerated rotation to the propeller shaft 32 when propelling the hull 2 forward and when propelling the hull backward. Therefore, the outboard motor 3 (see FIG. 2) is arranged to decelerate the rotation of the drive shaft 31 by both of the engagement portion between the bevel gear 310 and the front bevel gear 311 or the rear bevel gear 312, and by the planetary gear mechanism 35.

The reduction gear ratio of the planetary gear mechanism 35 is, for example, approximately 1.55. Also, as described above, the reduction gear ratio of the engagement portion between the bevel gear 310 and the front bevel gear 311 or the rear bevel gear 312 is, for example, approximately 1.75. Therefore, the rotation of the drive shaft 31 is preferably decelerated to approximately 1/(1.55×1.75), that is, approximately 1/2.71 and transmitted to the propeller shaft 32.

Next, a detailed structure of the planetary gear mechanism 35 will be described with reference to FIG. 4 to FIG. 6.

Figure 5:
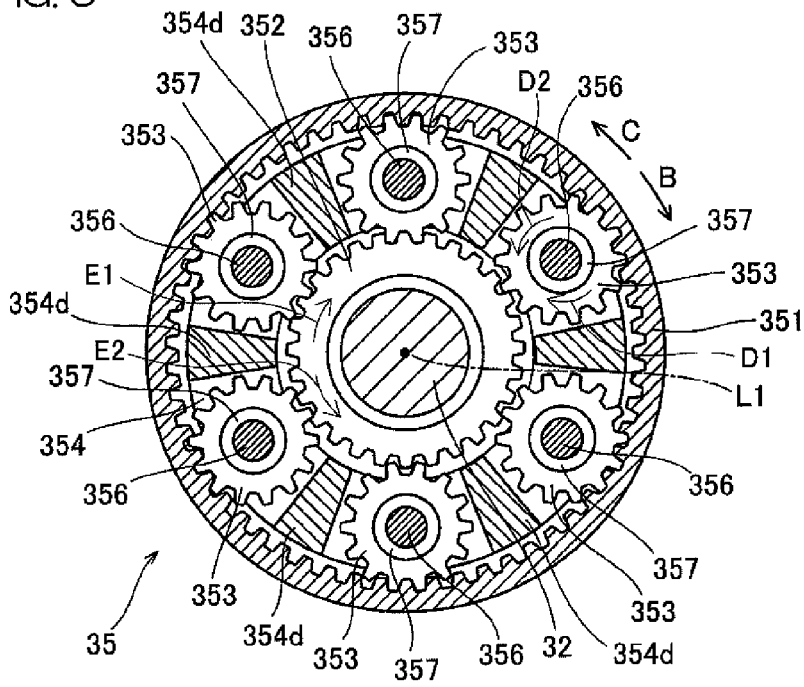
FIG. 5 is a sectional view for describing the arrangement of the planetary gear mechanism of the outboard motor with forward rotation specifications according to a preferred embodiment of the present invention.

FIG. 5 is a sectional view for describing an arrangement of the planetary gear mechanism of the outboard motor with forward rotation specifications of the present preferred embodiment of the present invention. Also, FIG. 6 is a perspective view for describing the arrangement of the planetary gear mechanism of the outboard motor with forward rotation specifications of the present preferred embodiment of the present invention.

The planetary gear mechanism 35 includes a ring gear 351, a sun gear 352, a plurality (for example, six) of planetary gears 353, and a carrier 354. The ring gear 351 is rotated about the central rotation axis L1 according to rotation of the intermediate shaft 34. Also, the sun gear 352 is fixed to the housing 304. Each planetary gear 353 is engaged with both of the ring gear 351 and the sun gear 352. Each planetary gear 353 is supported rotatably (rotatably on its own axis) by the carrier 354.

The ring gear 351 is engaged with the engagement portion 340*g* of the intermediate shaft 34. The ring gear 351 is arranged to be rotated according to rotation of the intermediate shaft 34. The ring gear 351 surrounds the sun gear 352 via a space in the radial direction.

As shown in FIG. 4, the sun gear 352 has a flange portion 352*a* extending in a direction perpendicular or substantially perpendicular to the central rotation axis L1. On the flange portion 352*a*, an annular projection 352*b* projecting backward is provided. The flange portion 352*a* and the projection 352*b* engage with the housing 304, respectively. The sun gear 352 is positioned in the front-back direction with respect to the housing 304 by the engagement between the flange portion 352*a* and the housing 304. Also, the sun gear 352 is positioned in a direction perpendicular or substantially perpendicular to the central rotation axis L1 with respect to the housing 304 by the engagement between the projection 352*b* and the housing 304.

The sun gear 352 is arranged to have, for example, a tubular shape. The sun gear 352 is arranged to surround the outer peripheral surface of the propeller shaft 32. Between the inner peripheral surface of the sun gear 352 and the outer peripheral surface of the propeller shaft 32, the bearing 355 is arranged. The bearing 355 supports the front portion of the propeller shaft 32. The bearing 355 is an example of "a second bearing" according to a preferred embodiment of the present invention.

Also, the six planetary gears 353 are arranged between the ring gear 351 and the sun gear 352, respectively. Each planetary gear 353 is arranged to have, for example, a tubular shape. Six shaft members 356 are inserted through the inner peripheries of the six planetary gears 353, respectively. Between the shaft member 356 and the planetary gear 353 corresponding to each other, a bearing 357 is arranged. Each planetary gear 353 is arranged to rotate in the direction D1 and in the direction D2 around the corresponding shaft member 356. The six shaft members 356 are respectively fixed to the carrier 354 which is rotatable about the central rotation axis L1. In the outboard motor 3 with forward rotation specifications, the direction D1 is a rotation direction of propelling the hull 2 forward. Also, in the outboard motor 3 with forward rotation specifications, the direction D2 is a rotation direction of propelling the hull 2 backward. The direction D1 and the direction D2 are opposite to each other.

Each planetary gear 353 rotates in the direction D1 or direction D2 around the corresponding shaft member 356 according to rotation in the direction B or the direction C of the ring gear 351. Also, each planetary gear 353 revolves around the sun gear 352 in the direction E1 (forward drive direction) or the direction E2 (reverse drive direction) about the central rotation axis L1 while rotating on its own axis. Each shaft member 356 rotates around the sun gear 352 in the direction E1 or the direction E2 about the central rotation axis L1 according to the revolution of the planetary gear 353.

Figure 6:
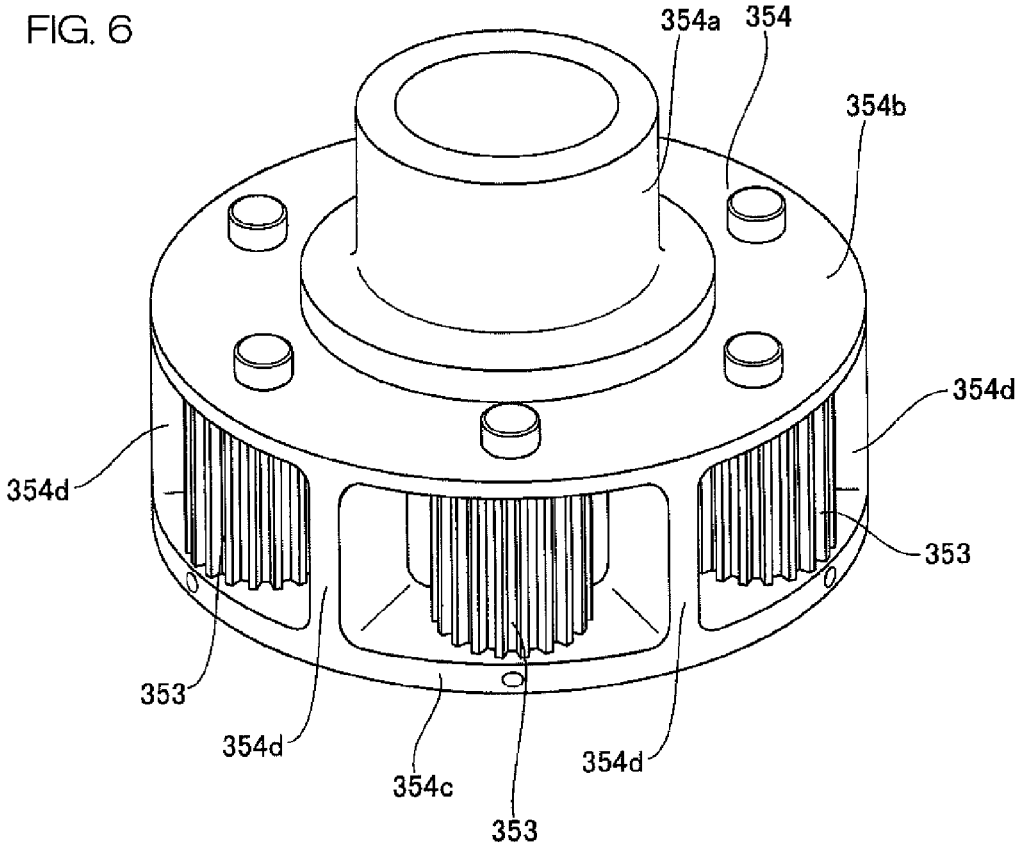
FIG. 6 is a perspective view for describing the arrangement of the planetary gear mechanism of the outboard motor with forward rotation specifications according to a preferred embodiment of the present invention.

As shown in FIG. 6, the carrier 354 includes a tubular portion 354*a*, annular flange portion 354*b* and flange portion 354*c*, and a plurality of columns 354*d*. The flange portion 354*b* projects in the direction perpendicular or substantially perpendicular to the tubular portion 354*a* from the outer peripheral surface of the tubular portion 354*a*. The flange portion 354*b* and the flange portion 354*c* oppose each other with six planetary gears 353 therebetween. One end portion and the other end portion of each shaft member 356 are fixed to the flange portion 354*b* and the flange portion 354*c*, respectively. The flange portion 354*b* and the flange portion 354*c* are coupled to each other by the plurality of columns 354*d*.

As shown in FIG. 4, the propeller shaft 32 is fitted to the inner periphery of the tubular portion 354*a* of the carrier 354. The tubular portion 354*a* and the propeller shaft 32 are integrally joined by a spline, for example. When the six shaft members 356 rotate in the direction E1 or the direction E2, the carrier 354 rotates in the direction B or the direction C. Also, when the carrier 354 rotates in the direction B or the direction C, the propeller shaft 32 rotates in the direction B or the direction C.

As shown in FIG. 4, on the rear end portion of the portion to which the carrier 354 is fitted to the propeller shaft 32, a stepped portion 320*a* is provided. Backward movement of the carrier 324 is restricted by the stepped portion 320*a*. That is, when propelling the hull 2 (see FIG. 1) forward, a propulsive force (force in the arrow FWD direction) from the propeller 33 is applied to the propeller shaft 32. At this time, the tubular portion 354*a* of the carrier 354 is pressed forward (the arrow FWD direction) by the stepped portion 320*a*. Therefore, backward movement of the carrier 354 is restricted by engagement with the stepped portion 320*a*.

Also, as shown in FIG. 4, between the flange portion 354*b* of the carrier 354 and the flange portion 340*f* of the intermediate shaft 34, a thrust bearing 358 is arranged. The thrust bearing 358 is an example of "a third bearing" according to a preferred embodiment of the present invention. When propelling the hull 2 forward, a force (force in the arrow FWD direction) transmitted from the stepped portion 320*a* of the propeller shaft 32 to the carrier 354 is transmitted from the flange portion 354*b* of the carrier 354 to the flange portion 340*f* of the intermediate shaft 34 via the thrust bearing 358. Therefore, the intermediate shaft 34 is urged forward when propelling the hull 2 forward.

Also, as shown in FIG. 4, on the front end portion of the intermediate shaft 34, a stepped portion 340*a* opposed in the front-back direction to the front bevel gear 311 is provided. When the intermediate shaft 34 is urged forward, the front bevel gear 311 is pressed forward by the stepped portion 340*a*. Therefore, when propelling the hull 2 forward, the front bevel gear 311 is urged forward by the intermediate shaft 34, and the bearing 313 is pressed forward by the front bevel gear 311.

Also, in the front end portion of the propeller shaft 32, an oil passage 320*b* is provided. The oil passage 320*b* includes a main passage 320*c* extending backward along the central rotation axis L1, and a front branched passage 320*d* and a rear branched passage 320*e* (see FIG. 3) branched from the main passage 320*c*. The front branched passage 320*d* is arranged ahead of the rear branched passage 320*e*. The front branched passage 320*d* is arranged at a position corresponding to a bearing 355 provided between the inner peripheral surface of the sun gear 352 and the outer peripheral surface of the propeller shaft 32.

The oil passage 320*b* is supplied with oil from the oil passage 340*e* provided in the front end portion of the intermediate shaft 34. The oil supplied to the oil passage 320*b* is distributed to the front branched passage 320*d* and the rear branched passage 320*e* through the main passage 320*c*. The oil supplied to the front branched passage 320*d* is supplied to the planetary gear mechanism 35 via the bearing 355. Also, the oil supplied to the rear branched passage 320*e* is supplied to a bearing 321 (see FIG. 3) which supports the propeller shaft 32 at the rear end portion of the lower case 303.

As shown in FIG. 4, on the rear side of the region in which the sun gear 352 is arranged of the propeller shaft 32, a flange portion 320*f* is integrally provided. The flange portion 320*f* is engaged with a thrust bearing 322 held on the housing 304. The propeller shaft 32 is restricted from moving backward by the engagement between the flange portion 320*f* and the thrust bearing 322. Also, the flange portion 320*f* is urged by the housing 304 via the thrust bearing 322.

Next, an arrangement of the outboard motor 4 with reverse rotation specifications will be described with reference to FIG. 7 to FIG. 9.

Figure 7:
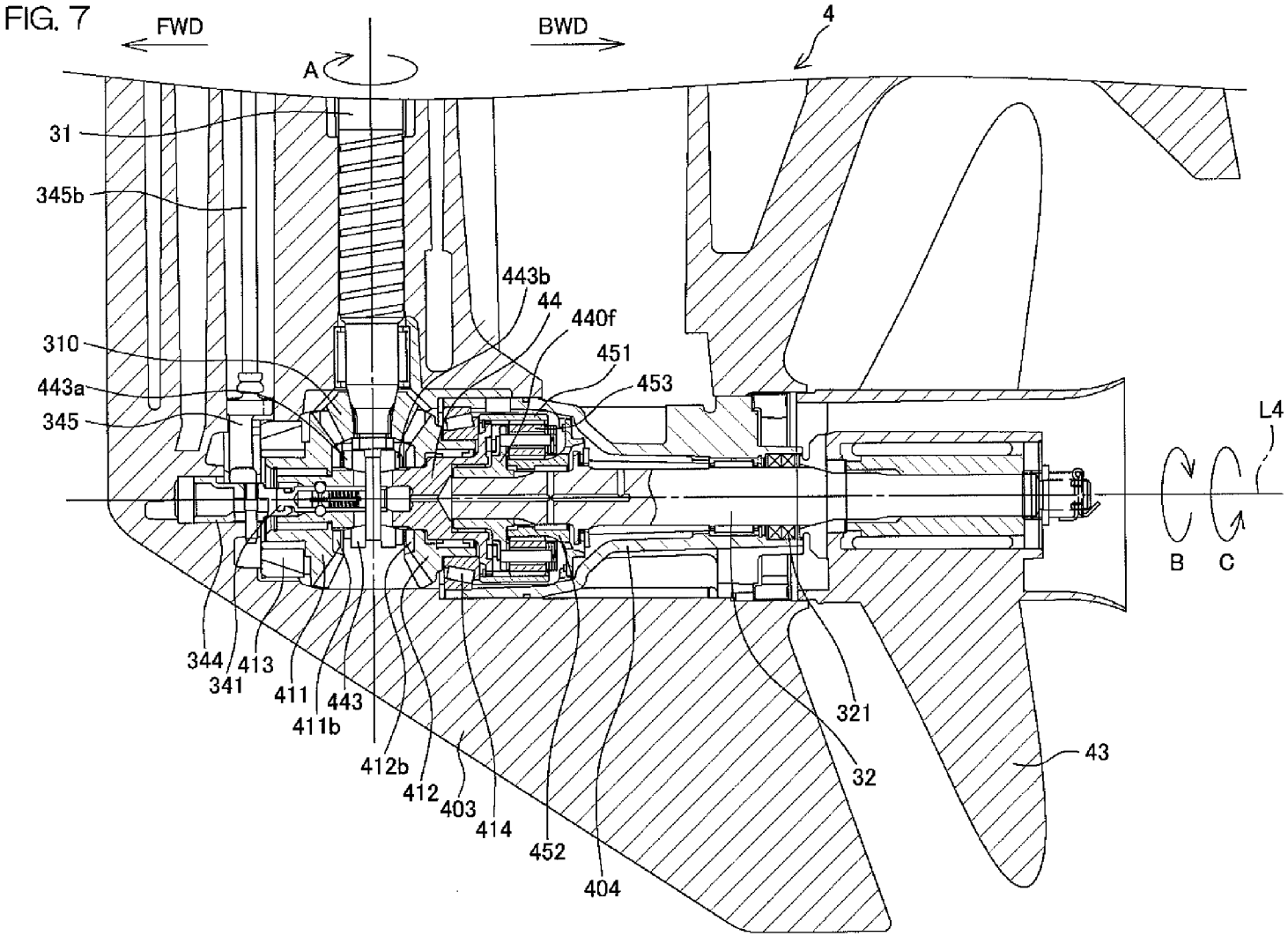
FIG. 7 is a sectional view for describing an arrangement inside a lower case of an outboard motor with reverse rotation specifications according to a preferred embodiment of the present invention.

FIG. 7 is a sectional view for describing an arrangement inside a lower case of the outboard motor with reverse rotation specifications of the present preferred embodiment of the present invention.

Different from the outboard motor 3, the outboard motor 4 is arranged to generate a propulsive force in the forward drive direction when a propeller 43 of the outboard motor 4 is rotated in the direction C about the central rotation axis L4. Further, the outboard motor 4 is arranged to generate a propulsive force in the reverse drive direction when the propeller 43 is rotated in the direction B about the central rotation axis L4. In other words, in the outboard motor 4 with reverse rotation specifications, the direction B is the reverse drive direction and the direction C is the forward drive direction. The outboard motor 4 is arranged to generate a propulsive force in the forward drive direction when a dog clutch 443 is engaged with a rear bevel gear 412. Further, the outboard motor 4 is arranged to generate a propulsive force in the reverse drive direction when the dog clutch 443 is engaged with a front bevel gear 411.

Figure 8:
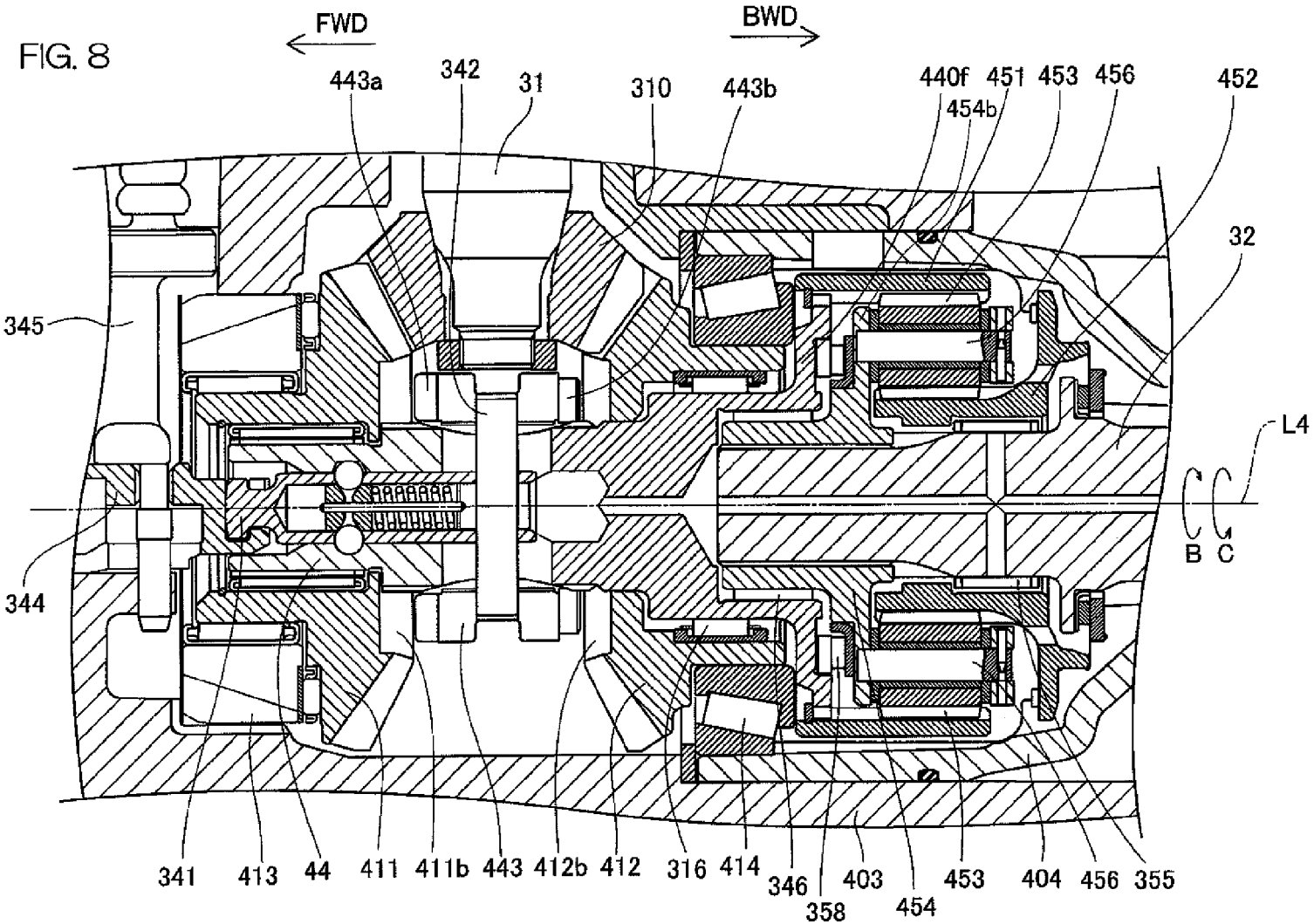
FIG. 8 is a sectional view for describing arrangements of an intermediate shaft and a planetary gear mechanism of the outboard motor with reverse rotation specifications according to a preferred embodiment of the present invention.

FIG. 8 is a sectional view for describing the structure of an intermediate shaft and a planetary gear mechanism of the outboard motor with reverse rotation specifications according to the present preferred embodiment of the present invention.

The front bevel gear 411 of the outboard motor 4 is fitted in a bearing 413. The bearing 413 is fixed to a lower case 403. The bearing 413 is arranged to stably support the front bevel gear 411 even when the front bevel gear 411 is rotated about the central rotation axis L4.

Also, the rear bevel gear 412 is fitted in a bearing 414. The bearing 414 is, for example, a tapered bearing. The bearing 414 is fixed to the lower case 403 via a housing 404. The bearing 414 is arranged to stably support the rear bevel gear 412 even when the rear bevel gear 412 is rotated about the central rotation axis L4.

Also, the bearing 414 is adjacent to a flange portion 440*f* of an intermediate shaft 44. When propelling the hull 2 forward, the propeller shaft 32 is pressed in the arrow FWD direction by the propeller 43. At this time, the flange portion 440*f* of the intermediate shaft 44 is pressed in the arrow FWD direction by a flange portion 454*b* of a carrier 454. The bearing 414 supports the flange portion 440*f* of the intermediate shaft 44 when the flange portion 440*f* is pressed in the arrow FWD direction by the flange portion 454*b* of the carrier 454.

Also, a planetary gear 453 is, for example, a helical gear. A ring gear 451 is arranged to be pressed in the arrow FWD direction by the planetary gear 453 when propelling the hull 2 forward.

Also, the flange portion 440*f* of the intermediate shaft 44 is arranged to be provided with a force in the arrow BWD direction by the propeller shaft 32 when propelling the hull 2 backward.

Also, the ring gear 451 is arranged to be provided with a force in the arrow BWD direction by the planetary gear 453 when propelling the hull 2 backward. Accordingly, between the bearing 414 and the flange portion 440*f*, a predetermined space (for example, approximately 0.1 millimeters) is provided.

Also, the dog clutch 443 is arranged such that the front dog 443*a* is engaged with a dog portion 411*b* of the front bevel gear 411 when the dog clutch 443 is slid in the arrow FWD direction. On the other hand, the dog clutch 443 is arranged such that the rear dog 443*b* is engaged with the dog portion 412*b* of the rear bevel gear 412 when the dog clutch 443 is slid in the arrow BWD direction.

The rotation in the direction B (reverse drive direction) about the central rotation axis L4 of the front bevel gear 411 is transmitted to the intermediate shaft 44 by engagement of the front dog 443*a* with the dog portion 411*b* of the front bevel gear 411. Also, the rotation in the direction C (forward drive direction) about the central rotation axis L4 of the rear bevel gear 412 is transmitted to the intermediate shaft 44 by engagement of the rear dog 443*b* with the dog portion 412*b* of the rear bevel gear 412.

Figure 9:
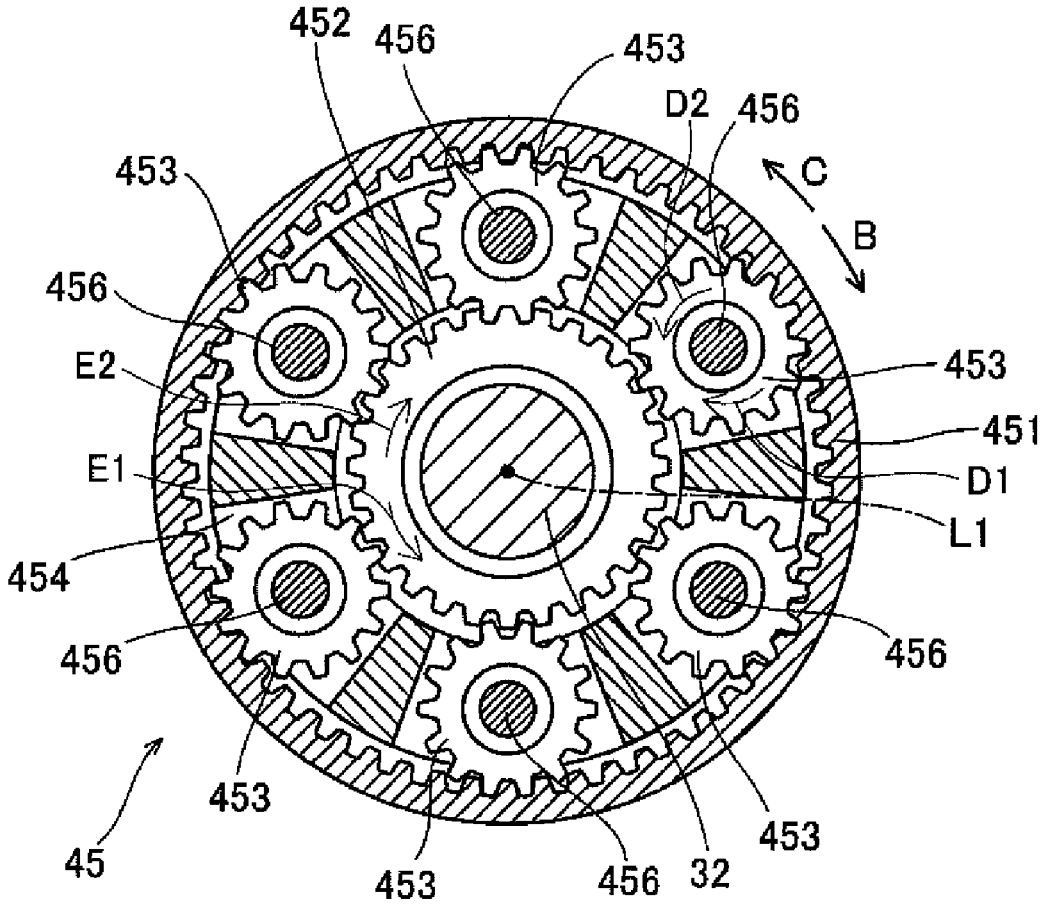
FIG. 9 is a sectional view for describing the arrangement of the planetary gear mechanism of the outboard motor with reverse rotation specifications according to a preferred embodiment of the present invention.

FIG. 9 is a sectional view for describing an arrangement of a planetary gear mechanism of the outboard motor with reverse rotation specifications according to the present preferred embodiment of the present invention.

In the outboard motor 4 with reverse rotation specifications, when propelling the hull 2 forward and when propelling the hull 2 backward, gears constituting the planetary gear mechanism 45 rotate oppositely to the gears constituting the planetary gear mechanism 35 of the outboard motor 3 with forward rotation specifications. In detail, the ring gear 451 is arranged to be rotated in the direction C when propelling the hull 2 forward. Also, the six planetary gears 453 are arranged to be rotated in the direction D2 about sun gear 452 when propelling the hull 2 forward. Also, the shaft members 456 are arranged to be rotated in the direction E2 when propelling the hull 2 forward. Also, the carrier 454 is arranged to be rotated in the direction C when propelling the hull 2 forward. Accordingly, the propeller shaft 32 is rotated in the direction C (forward drive direction) and a propulsive force of propelling the hull 2 forward is generated.

On the other hand, the ring gear 451 is arranged to be rotated in the direction B when propelling the hull 2 backward. Also, the six planetary gears 453 are arranged to be rotated in the direction D1 when propelling the hull 2 backward. Also, the shaft members 456 are arranged to be rotated in the direction E1 when propelling the hull 2 backward. Also, the carrier 454 is arranged to be rotated in the direction B when propelling the hull 2 backward. Accordingly, the propeller shaft 32 is rotated in the direction B (reverse drive direction) and a propulsive force of propelling the hull 2 backward is generated.

In addition, other components of the outboard motor 4 with reverse rotation specifications are the same as those of the outboard motor 3 with forward rotation specifications.

Next, a driving force transmission path from the drive shaft 31 to the propeller 33 of the outboard motor 3 with forward rotation specifications will be described with reference to FIG. 2, FIG. 4 and FIG. 5. First, a driving force transmission path when propelling the hull 2 forward will be described.

When propelling the hull 2 forward, the front dog 343*a* of the dog clutch 343 is engaged with the dog portion 311*b* of the front bevel gear 311. The crankshaft 30*a* is rotated in the direction A by the driving force of the engine 30. The drive shaft 31 is rotated in the direction A according to the rotation in the direction A of the crankshaft 30*a*.

According to the rotation in the direction A of the drive shaft 31, the bevel gear 310 attached to the vicinity of the lower end portion of the drive shaft 31 is rotated in the direction A. Then, according to the rotation in the direction A of the bevel gear 310, the front bevel gear 311 is rotated in the direction B. On the other hand, according to the rotation in the direction A of the bevel gear 310, the rear bevel gear 312 is rotated in the direction C. The dog clutch 343 and the front bevel gear 311 are engaged with each other, so that the rotation in the direction B of the front bevel gear 311 is transmitted to the intermediate shaft 34. Accordingly, the intermediate shaft 34 is rotated in the direction B.

Then, the rotation in the direction B of the intermediate shaft 34 is transmitted from the engagement portion 340*g* of the intermediate shaft 34 to the planetary gear mechanism 35. In detail, the engagement portion 340*g* of the intermediate shaft 34 and the ring gear 351 of the planetary gear mechanism 35 are engaged with each other, so that the ring gear 351 is rotated in the direction B. Accordingly, the six planetary gears 353 engaged with the ring gear 351 are rotated in the direction D1, respectively. Therefore, the six planetary gears 353 are respectively moved in the direction E1 around the central rotation axis L1. Further, according to the movements in the direction E1 of the six planetary gears 353, six shaft members 356 supporting the six planetary gears 353 are also moved in the direction E1 around the central rotation axis L1. Accordingly, the carrier 354 to which the six shaft members 356 are fixed is subjected to a force in the direction E1 around the central rotation axis L1 by the six shaft members 356. As a result, the carrier 354 is rotated in the direction B.

The carrier 354 is preferably spline-fitted to the propeller shaft 32, so that the propeller shaft 32 is rotated in the direction B together with the carrier 354. Also, the propeller shaft 32 and the propeller 33 are arranged to rotate integrally, so that according to the rotation in the direction B of the propeller shaft 32, the propeller 33 is rotated in the direction B. Accordingly, a propulsive force of propelling the hull 2 forward is generated. The rotation of the intermediate shaft 34 is decelerated in the process of transmission from the ring gear 351 to the carrier 354, so that the rotation speed of the propeller shaft 32 is slower than that of the intermediate shaft 34.

Next, a driving force transmission path from the drive shaft 31 to the propeller 33 of the outboard motor 3 with forward rotation specifications when propelling the hull 2 backward will be described with reference to FIG. 2, FIG. 4, and FIG. 5.

When propelling the hull 2 backward, the rear dog 343*b* of the dog clutch 343 is engaged with the dog portion 312*b* of the rear bevel gear 312. The bevel gear 310 attached to the vicinity of the lower end portion of the drive shaft 31 is rotated in the direction A according to the rotation in the direction A of the drive shaft 31. The front bevel gear 311 is rotated in the direction B according to the rotation in the direction A of the bevel gear 310. On the other hand, the rear bevel gear 312 is rotated in the direction C according to the rotation in the direction A of the drive shaft 31. The dog clutch 343 and the rear bevel gear 312 are engaged with each other so that the rotation in the direction C of the rear bevel gear 312 is transmitted to the intermediate shaft 34. Accordingly, the intermediate shaft 34 is rotated in the direction C.

Then, the rotation in the direction C of the intermediate shaft 34 is transmitted from the engagement portion 340*g* of the intermediate shaft 34 to the planetary gear mechanism 35. In detail, the engagement portion 340*g* of the intermediate shaft 34 and the ring gear 351 of the planetary gear mechanism 35 are engaged with each other, so that the ring gear 351 is rotated in the direction C. Accordingly, the six planetary gears 353 engaged with the ring gear 351 are respectively rotated in the direction D2. Therefore, the six planetary gears 353 are respectively moved in the direction E2 around the central rotation axis L1. Also, according to the rotations in the direction E2 of the six planetary gears 353, the six shaft members 356 supporting the six planetary gears 353 are also moved in the direction E2 about the central rotation axis L1. Accordingly, the carrier 354 to which the six shaft members 356 are fixed is subjected to a force in the direction E2 around the central rotation axis L1 by the six shaft members 356. As a result, the carrier 354 is rotated in the direction C. The carrier 354 is preferably spline-fitted to the propeller shaft 32, so that the propeller shaft 32 is rotated in the direction C together with the carrier 354. Also, the propeller shaft 32 and the propeller 33 are arranged to rotate integrally, so that according to the rotation in the direction C of the propeller shaft 32, the propeller 33 is rotated in the direction C. Accordingly, a propulsive force of propelling the hull 2 backward is generated. The rotation of the intermediate shaft 34 is decelerated in the process of transmission from the ring gear 351 to the carrier 354, so that the rotation speed of the propeller shaft 32 is slower than that of the intermediate shaft 34.

Next, technical effects and advantages of the outboard motors of the preferred embodiments of the present invention will be illustrated hereinafter.

In the present preferred embodiment, the planetary gear mechanism 35 is arranged on the central rotation axis L1 of the propeller shaft 32. The planetary gear mechanism 35 decelerates the rotation of the propeller shaft 32 when propelling the hull 2 forward and when propelling the hull 2 backward. Therefore, when propelling the hull 2 forward and propelling the hull 2 backward, a high-torque driving force is transmitted to the propellers 33 and 43. Also, the planetary gear mechanism 35 is arranged on the central rotation axis L1 of the propeller shaft 32, so that the area to which a great driving force is applied is limited to the range on the downstream side of the drive shaft 31. Accordingly, the high-torque driving force can be prevented from being applied to the drive shaft 31 and a drive system, etc., arranged on the upstream side of the drive shaft 31.

In order to transmit a high-torque driving force to the propellers 33 and 43 when propelling the hull 2 forward and when propelling the hull 2 backward, for example, a method in which the gear ratio of the bevel gears (the bevel gear 310 and the front and rear bevel gears 311 and 312) is increased without providing the planetary gear mechanism 35 is possible. However, in this method, a driving force input into the drive shaft 31 may not be reliably transmitted to the propeller shaft 32.

In further detail, to increase the gear ratio of the bevel gears, for example, the number of teeth of the drive gear (bevel gear 310) must be reduced. Also, if the number of teeth of the drive gear is merely reduced, the engagement state between the drive gear and the driven gears (the front bevel gear 311 and the rear bevel gear 312) changes, so that the drive gear and the driven gears must be adjusted to keep the engagement state constant. However, if the number of teeth of the drive gear is reduced while keeping the engagement state between the drive gear and the driven gears constant, the outer diameter of the drive gear is reduced. Therefore, the thickness (radial thickness) of the drive gear is reduced, and the rigidity of the drive gear is reduced. Therefore, the driving force input into the drive shaft 31 may not be reliably transmitted to the bevel gear 310.

A possible method to prevent the reduction in rigidity of the drive gear when the number of teeth of the drive gear is reduced while keeping the engagement state between the drive gear and the driven gears constant is to reduce the inner diameter of the drive gear. However, in this case, the drive shaft 31 becomes thinner and the rigidity of the drive shaft 31 is reduced. Therefore, the driving force input into the drive shaft 31 may not be reliably transmitted to the bevel gear 310. On the other hand, in the present preferred embodiment, the gear ratio of the bevel gears is preferably set so as to realize reliable transmission of the driving force input into the drive shaft 31 to the propeller shaft 32. Therefore, the driving force input into the drive shaft 31 is reliably transmitted to the planetary gear mechanism 35. Accordingly, when propelling the hull 2 forward and when propelling the hull 2 backward, a high-torque driving force is reliably transmitted to the propellers 33 and 43.

Also, in the present preferred embodiment, the front bevel gear 311 is supported by the bearing 313 which is preferably a tapered bearing. The front bevel gear 311 is pressed forward by the intermediate shaft 34 when the hull 2 is moved forward. Then, the front bevel gear 311 presses the bearing 313 forward. Therefore, when the hull 2 is moved forward, the internal space of the bearing 313 is reduced and the front bevel gear 311 is stably supported by the bearing 313. Accordingly, the front bevel gear 311 can be stably rotated.

Also, in the present preferred embodiment, the planetary gear mechanism 35 is provided on the downstream side of the dog clutch 343. Therefore, in both of the case in which the rotation direction of the propeller shaft 32 is set to the forward drive direction and the case in which the rotation direction of the propeller shaft 32 is set to the reverse drive direction, the planetary gear mechanism 35 can decelerate the rotation of the drive shaft 31 and transmit it to the propeller shaft 32. That is, in both of the case in which the dog clutch 343 is engaged with the front bevel gear 311 and the case in which the dog clutch 343 is engaged with the rear bevel gear 312, the planetary gear mechanism 35 can decelerate the rotation of the drive shaft 31 and transmit it to the propeller shaft 32. Accordingly, without providing a plurality of reduction gear mechanisms including a reduction gear mechanism for forward driving and a reduction gear mechanism for reverse driving, the rotation of the drive shaft 31 can be decelerated and transmitted to the propeller shaft 32.

Also, in the present preferred embodiment, the rotation of the drive shaft 31 is decelerated by the planetary gear mechanism 35, the bevel gear 310, the front bevel gear 311, and the rear bevel gear 312 and transmitted to the propeller shaft 32. Therefore, as compared with the case in which only the planetary gear mechanism 35 is provided or the case in which only the bevel gear 310, the front bevel gear 311, and the rear bevel gear 312 are provided, a higher reduction gear ratio can be obtained.

Also, in the present preferred embodiment, the intermediate shaft 34 includes the flange portion 340*f* extending in a direction perpendicular or substantially perpendicular to the extending direction of the intermediate shaft 34 and an engagement portion 340*g* provided on the outer peripheral portion of the flange portion 340*f*. The engagement portion 340*g* of the intermediate shaft 34 is engaged with the ring gear 351. Therefore, the intermediate shaft 34 can transmit a driving force to the planetary gear mechanism 35.

Also, in the present preferred embodiment, the bearing 355 is arranged between the inner peripheral surface of the sun gear 352 and the outer peripheral surface of the propeller shaft 32. The propeller shaft 32 is supported on the sun gear 352 via the bearing 355. Also, the sun gear 352 is fixed to the housing 304. Therefore, the propeller shaft 32 is supported on the housing 304 via the bearing 355 and the sun gear 352. Accordingly, the propeller shaft 32 is rotatably supported.

Also, in the present preferred embodiment, the intermediate shaft 34 and the carrier 354 are opposed to each other. The bushing 346 and the thrust bearing 358 are arranged between the intermediate shaft 34 and the carrier 354. Therefore, the bushing 346 and the thrust bearing 358 can prevent interference of the intermediate shaft 34 and the carrier 354.

Also, in the present preferred embodiment, the oil passages 320*b* and 340*e* arranged to supply oil to the planetary gear mechanism 35 are respectively provided in the propeller shaft 32 and the intermediate shaft 34. Therefore, by letting oil flow in the oil passages 320*b* and 340*e*, the oil can be easily supplied to the planetary gear mechanism 35.

The preferred embodiments of the present invention are described above, and the present invention is not limited to the contents of the above-described preferred embodiments, and can be variously changed within the scope of the claims. For example, the preferred embodiments described above show an example in which two outboard motors as an example of a marine vessel propulsion unit are attached to the hull. However, the number of outboard motors may be one or three or more. Also, the marine vessel propulsion unit is not limited to an outboard motor including an engine and a propeller which are arranged outside the hull, and may be a different type of unit such as an inboard/outboard motor 501 shown in FIG. 10, for example.

Figure 10:
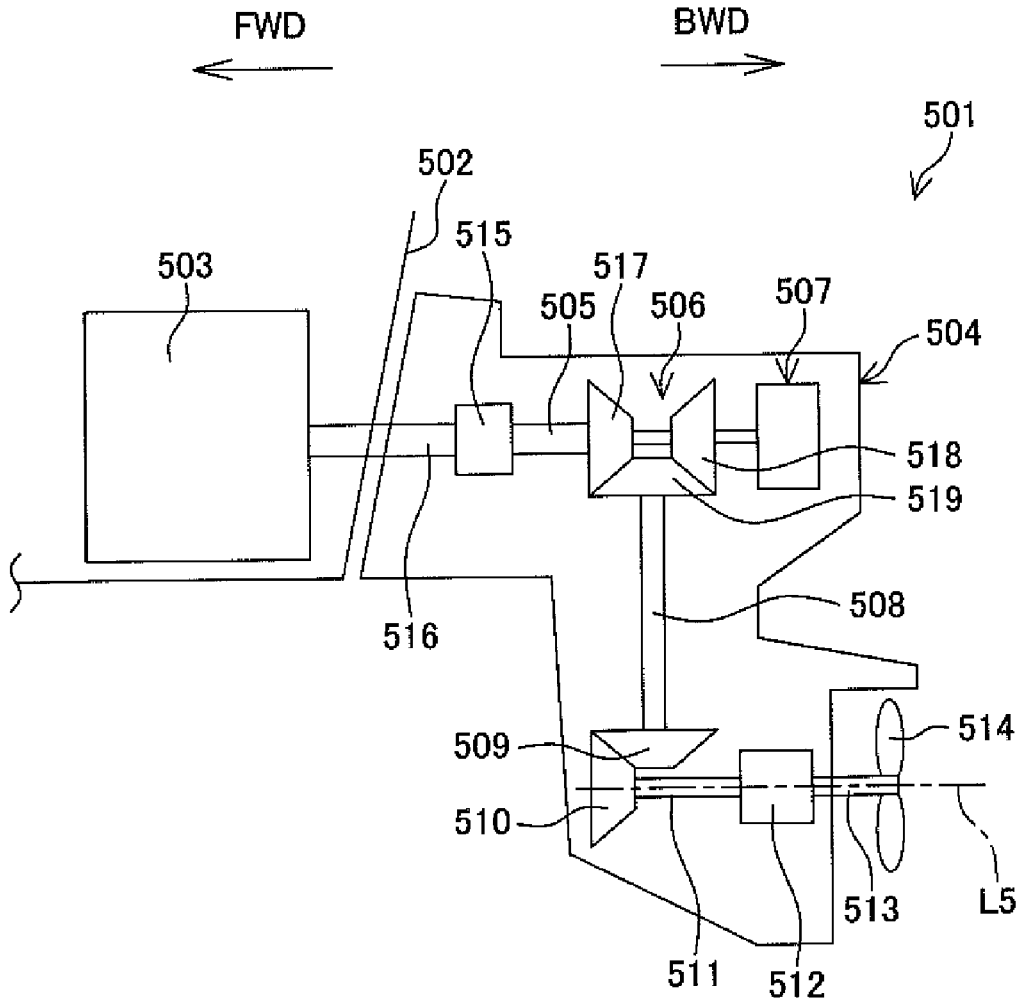
FIG. 10 is a schematic view for describing an arrangement of an inboard/outboard motor according to another preferred embodiment of the present invention.

The inboard/outboard motor 501 shown in FIG. 10 includes an engine 503 arranged inside the hull 502, and a drive unit 504 arranged outside the hull 502. The drive unit 504 includes an input shaft 505, a gear mechanism 506, a forward-reverse switching mechanism 507, and a drive shaft 508. Further, the drive unit 504 includes a drive gear 509, a driven gear 510, an intermediate shaft 511, a planetary gear mechanism 512, a propeller shaft 513, and a propeller 514.

One end portion of the input shaft 505 is joined to an output shaft 516 of the engine 503 via a universal joint 515. Also, the gear mechanism 506 includes a front bevel gear 517, a rear bevel gear 518, and a lower bevel gear 519. The front bevel gear 517 and the rear bevel gear 518 are spaced from each other in the front-back direction. The lower bevel gear 519 is engaged with the front bevel gear 517 and the rear bevel gear 518. Also, the lower bevel gear 519 is joined to the upper end portion of the drive shaft 508. An input shaft 505 is selectively integrally joined to the front bevel gear 517 or the rear bevel gear 518 by the forward-reverse switching mechanism 507.

Also, the drive gear 509 and the driven gear 510 are, for example, bevel gears. The drive gear 509 is joined to the lower end portion of the drive shaft 508. The driven gear 510 is engaged with the drive gear 509. The driven gear 510 is integrally joined to the intermediate shaft 511. Also, the intermediate shaft 511 is joined to the propeller shaft 513 via the planetary gear mechanism 512. The intermediate shaft 511 is arranged on the central rotation axis L5 of the propeller shaft 513.

The planetary gear mechanism 512 is an example of "a first reduction gear mechanism" according to a preferred embodiment of the present invention. The planetary gear mechanism 512 is arranged on the central rotation axis L5 of the propeller shaft 513. The planetary gear mechanism 512 may be arranged on the extension of the central rotation axis L5. The detailed arrangement of the planetary gear mechanism 512 is the same as that of the planetary gear mechanism 35 described above.

When propelling the hull 502 forward by the inboard/outboard motor 501 shown in FIG. 10, the input shaft 505 is joined to the front bevel gear 517 by the forward-reverse switching mechanism 507. Accordingly, the rotation of the engine 503 is transmitted to the lower bevel gear 519 via the input shaft 505 and the front bevel gear 517. Therefore, the lower bevel gear 519 and the drive shaft 508 rotate integrally in a predetermined direction. Then, the rotation of the drive shaft 508 is transmitted to the intermediate shaft 511 via the drive gear 509 and the driven gear 510, and the rotation of the intermediate shaft 511 is transmitted to the propeller shaft 513 via the planetary gear mechanism 512. Accordingly, a high-torque driving force is transmitted to the propeller 514, and the propeller 514 rotates in the predetermined direction.

On the other hand, when propelling the hull 502 backward by the inboard/outboard motor 501 shown in FIG. 10, the input shaft 505 is joined to the rear bevel gear 518 by the forward-reverse switching mechanism 507. Accordingly, the rotation of the engine 503 is transmitted to the lower bevel gear 519 via the input shaft 505 and the rear bevel gear 518. Therefore, the lower bevel gear 519 and the drive shaft 508 rotate integrally in a direction opposite to the above-described predetermined direction. Then, the rotation of the drive shaft 508 is transmitted to the intermediate shaft 511 via the drive gear 509 and the driven gear 510, and the rotation of the intermediate shaft 511 is transmitted to the propeller shaft 513 via the planetary gear mechanism 512. Accordingly, a high-torque driving force is transmitted to the propeller 514, and the propeller 514 rotates in the direction opposite to the predetermined direction.

Also, the preferred embodiments described above show an example in which the first reduction gear mechanism preferably is a planetary gear mechanism. However, the first reduction gear mechanism may be a mechanism other than a planetary gear mechanism. For example, the first reduction gear mechanism may be a gear mechanism including a plurality of bevel gears. In this case, the gear mechanism is preferably arranged on the central rotation axis of the propeller shaft or the extension of the central rotation axis.

Also, the preferred embodiments described above show an example in which a planetary gear mechanism is preferably provided on the central rotation axis of the propeller shaft. However, the planetary gear mechanism may be arranged on the extension of the central rotation axis ahead of the propeller shaft.

Also, the preferred embodiments described above show an example in which the sun gear is preferably fixed and a driving force input into the ring gear is preferably output from the carrier. However, for example, it is possible that the ring gear is fixed and a driving force input into the sun gear is output from the carrier.

The present application corresponds to Japanese Patent Application No. 2008-292970 and Japanese Patent Application No. 2009-012335 filed on Nov. 17, 2008 and Jan. 22, 2009, respectively, in the Japan Patent Office, and the entire disclosures of these applications are incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine vessel propulsion unit comprising:

an engine;

a drive shaft arranged to be rotated by the engine;

a propeller shaft to which rotation of the drive shaft is transmitted, the propeller shaft extending in a direction perpendicular or substantially perpendicular to the drive shaft;

a propeller arranged to be rotated together with the propeller shaft;

an intermediate shaft arranged on a central rotation axis of the propeller shaft or an extension of the central rotation axis, the intermediate shaft arranged to transmit rotation between the drive shaft and the propeller shaft;

a gear mechanism including a drive gear integrally joined to a lower end of the drive shaft, and a driven gear engaged with the drive gear so as to be rotated about the central rotation axis of the propeller shaft to transmit the rotation of the drive shaft to the intermediate shaft;

a first reduction gear mechanism arranged on the central rotation axis of the propeller shaft or the extension of the central rotation axis, the first reduction gear mechanism arranged to decelerate the rotation of the intermediate shaft so as to transmit the decelerated rotation to the propeller shaft both in a forward propulsion and a backward propulsion of the marine vessel propulsion unit; and a lower case arranged to house a portion of the drive shaft, the drive gear, the driven gear, and the first reduction gear mechanism; wherein the first reduction gear mechanism is arranged on the central rotation axis between the driven gear and the propeller.

2. The marine vessel propulsion unit according to claim 1, further comprising a forward-reverse switching mechanism arranged to switch a rotation direction of the propeller shaft to a forward drive direction or a reverse drive direction, wherein the first reduction gear mechanism is arranged on a downstream side of the forward-reverse switching mechanism along a driving force transmission path from the engine to the propeller.

3. The marine vessel propulsion unit according to claim 1, wherein the drive gear and the driven gear in the gear mechanism define a second reduction gear mechanism arranged to decelerate the rotation of the drive shaft and to transmit the decelerated rotation to the intermediate shaft.

4. The marine vessel propulsion unit according to claim 3, further comprising:

a forward-reverse switching mechanism arranged to switch a rotation direction of the propeller shaft to a forward drive direction or a reverse drive direction; wherein the driven gear includes a first bevel gear engaged with the drive gear and rotated in a first direction about the central rotation axis of the propeller shaft, and a second bevel gear engaged with the drive gear and rotated in a second direction opposite to the first direction about the central rotation axis of the propeller shaft; and the forward-reverse switching mechanism includes a clutch portion integrally joined to the intermediate shaft and arranged to be engaged with either the first bevel gear or the second bevel gear.

5. The marine vessel propulsion unit according to claim 4, further comprising a first bearing in which the first bevel gear is fitted, wherein the first bevel gear is arranged to press the first bearing by being pressed by the intermediate shaft to reduce an internal space of the first bearing when the hull is moved forward.

6. The marine vessel propulsion unit according to claim 1, wherein the first reduction gear mechanism includes a planetary gear mechanism arranged on an outer peripheral portion of the propeller shaft.

7. The marine vessel propulsion unit according to claim 6, further comprising a housing provided in the lower case and arranged to house the planetary gear mechanism, wherein the planetary gear mechanism includes:

a ring gear integrally joined to the intermediate shaft and rotatable about the central rotation axis of the propeller shaft;

a sun gear positioned on an inner side of the ring gear and fixed to the housing;

a plurality of planetary gears engaged with the ring gear and the sun gear by being located therebetween and arranged to move around the sun gear according to the rotation of the ring gear; and a carrier arranged to support the planetary gears, and arranged to be rotated about the central rotation axis of the propeller shaft in a state in which rotation of the carrier is decelerated to be slower than the intermediate shaft according to the movements of the planetary gears around the sun gear; wherein the propeller shaft is arranged to rotate together with the carrier.

8. The marine vessel propulsion unit according to claim 7, wherein the intermediate shaft includes a flange portion arranged to extend in a direction perpendicular or substantially perpendicular to a direction in which the intermediate shaft extends, and an engagement portion which is provided on an outer peripheral portion of the flange portion, and the engagement portion of the intermediate shaft is arranged to be engaged with the ring gear.

9. The marine vessel propulsion unit according to claim 7, wherein the sun gear has a tubular shape surrounding the outer peripheral portion of the propeller shaft, and the marine vessel propulsion unit further comprises a bearing arranged between an inner peripheral surface of the sun gear and the outer peripheral portion of the propeller shaft.

10. The marine vessel propulsion unit according to claim 7, wherein the intermediate shaft and the carrier are opposed to each other, and the marine vessel propulsion unit further comprises a bearing arranged between the intermediate shaft and the carrier.

11. The marine vessel propulsion unit according to claim 1, wherein the propeller shaft and the intermediate shaft include oil passages which are arranged to supply oil to the first reduction gear mechanism.

12. A marine vessel propulsion unit comprising:

an engine;

a drive shaft arranged to be rotated by the engine;

a propeller shaft to which rotation of the drive shaft is transmitted;

a propeller arranged to be rotated together with the propeller shaft;

an intermediate shaft arranged on a central rotation axis of the propeller shaft or an extension of the central rotation axis, the intermediate shaft arranged to transmit rotation between the drive shaft and the propeller shaft;

a first reduction gear mechanism arranged on the central rotation axis of the propeller shaft or the extension of the central rotation axis, the first reduction gear mechanism arranged to decelerate the rotation of the intermediate shaft so as to transmit the decelerated rotation to the propeller shaft both in a forward propulsion and a backward propulsion of the marine vessel propulsion unit, the first reduction gear mechanism including a planetary gear mechanism arranged on an outer peripheral portion of the propeller shaft; and a housing which is arranged to house the planetary gear mechanism, wherein the planetary gear mechanism includes:

a ring gear integrally joined to the intermediate shaft and rotatable about the central rotation axis of the propeller shaft;

a sun gear positioned on an inner side of the ring gear and fixed to the housing;

a plurality of planetary gears engaged with the ring gear and the sun gear by being located therebetween and arranged to move around the sun gear according to the rotation of the ring gear; and a carrier arranged to support the planetary gears, and arranged to be rotated about the central rotation axis of the propeller shaft in a state in which rotation of the carrier is decelerated to be slower than the intermediate shaft according to the movements of the planetary gears around the sun gear; wherein the propeller shaft is arranged to rotate together with the carrier; and the intermediate shaft includes a flange portion arranged to extend in a direction perpendicular or substantially perpendicular to a direction in which the intermediate shaft extends, and an engagement portion which is provided on an outer peripheral portion of the flange portion, and the engagement portion of the intermediate shaft is arranged to be engaged with the ring gear.

13. A marine vessel propulsion unit comprising:

an engine;

a drive shaft arranged to be rotated by the engine;

a propeller shaft to which rotation of the drive shaft is transmitted;

a propeller arranged to be rotated together with the propeller shaft;

an intermediate shaft arranged on a central rotation axis of the propeller shaft or an extension of the central rotation axis, the intermediate shaft arranged to transmit rotation between the drive shaft and the propeller shaft;

a first reduction gear mechanism arranged on the central rotation axis of the propeller shaft or the extension of the central rotation axis, the first reduction gear mechanism arranged to decelerate the rotation of the intermediate shaft so as to transmit the decelerated rotation to the propeller shaft both in a forward propulsion and a backward propulsion of the marine vessel propulsion unit, the first reduction gear mechanism including a planetary gear mechanism arranged on an outer peripheral portion of the propeller shaft; and a housing which is arranged to house the planetary gear mechanism, wherein the planetary gear mechanism includes:

a ring gear integrally joined to the intermediate shaft and rotatable about the central rotation axis of the propeller shaft;

a sun gear positioned on an inner side of the ring gear and fixed to the housing;

a plurality of planetary gears engaged with the ring gear and the sun gear by being located therebetween and arranged to move around the sun gear according to the rotation of the ring gear; and a carrier arranged to support the planetary gears, and arranged to be rotated about the central rotation axis of the propeller shaft in a state in which rotation of the carrier is decelerated to be slower than the intermediate shaft according to the movements of the planetary gears around the sun gear; wherein the propeller shaft is arranged to rotate together with the carrier; and the sun gear has a tubular shape surrounding the outer peripheral portion of the propeller shaft, and the marine vessel propulsion unit further comprises a bearing arranged between an inner peripheral surface of the sun gear and the outer peripheral portion of the propeller shaft.

* * * * *